US008604719B2

(12) United States Patent
Takeuchi

(10) Patent No.: US 8,604,719 B2
(45) Date of Patent: Dec. 10, 2013

(54) LIGHT-EMITTING ELEMENT DRIVING CIRCUIT SYSTEM

(75) Inventor: Takuya Takeuchi, Osaka (JP)

(73) Assignees: Sanyo Semiconductor Co., Ltd. (JP); Semiconductor Components Industries, LLC, Phoenix, AZ (US)

( * ) Notice: Subject to any disclaimer, the term of this patent is extended or adjusted under 35 U.S.C. 154(b) by 507 days.

(21) Appl. No.: 12/942,339

(22) Filed: Nov. 9, 2010

(65) Prior Publication Data

US 2011/0109251 A1 May 12, 2011

(30) Foreign Application Priority Data

Nov. 9, 2009 (JP) ..... 2009-256232

(51) Int. Cl.

| | |
|---|---|
| ***H05B 37/00*** | (2006.01) |
| ***H05B 39/00*** | (2006.01) |
| ***H05B 41/00*** | (2006.01) |
| *H05B 37/02* | (2006.01) |
| *H05B 39/04* | (2006.01) |
| *H05B 41/36* | (2006.01) |

(52) U.S. Cl.
USPC ..... 315/320; 315/210; 315/294

(58) Field of Classification Search
None
See application file for complete search history.

(56) References Cited

U.S. PATENT DOCUMENTS

| | | | | |
|---|---|---|---|---|
| 6,867,757 | B1 | 3/2005 | Nakamura | |
| 7,642,724 | B2 | 1/2010 | Muto et al. | |
| 7,791,498 | B2 * | 9/2010 | Park | 340/815.45 |

FOREIGN PATENT DOCUMENTS

| | | | |
|---|---|---|---|
| CN | 1265506 | A | 9/2000 |
| JP | 2008-251886 | A | 10/2008 |
| JP | 2008304694 | A | 12/2008 |
| JP | 2009032497 | A | 2/2009 |
| JP | 2009252939 | A | 10/2009 |

OTHER PUBLICATIONS

The First Office Action for Chinese Patent Application 2010105397052, dated Sep. 5, 2012, with English translation.
Notice of Grounds for Rejection for Japanese Patent Application No. 2009-256232; Date of Mailing: Oct. 1, 2013, with English Translation.

* cited by examiner

*Primary Examiner* — Douglas W Owens
*Assistant Examiner* — Dedei K Hammond
(74) *Attorney, Agent, or Firm* — Cantor Colburn LLP

(57) ABSTRACT

A light-emitting element driving circuit system is provided in which a plurality of current paths, in each of which a light-emitting element and a switching element which is controlled to be switched ON and OFF for causing light to be emitted from the light-emitting element are connected in series, are placed in parallel to each other, wherein an ON time of each switching element is adjusted based on a light-emission period which is a period in which the light-emitting elements are caused to emit light in a circulating manner, such that a number of switching operations of each switching element is reduced.

4 Claims, 2 Drawing Sheets

LIGHT-EMITTING ELEMENT DRIVING CIRCUIT SYSTEM

CROSS-REFERENCE TO RELATED APPLICATIONS

The entire disclosure of Japanese Patent Application No. 2009-256232 filed on Nov. 9, 2009, including specification, claims, drawings, and abstract, is incorporated herein by reference in its entirety.

BACKGROUND

1. Technical Field

The present invention relates to a light-emitting element driving circuit system, and in particular, to a light-emitting element driving circuit system which drives a plurality of light-emitting elements.

2. Background Art

Recently, a light-emitting element driving circuit system is equipped in various electronic devices such as a portable phone. For example, Patent Literature 1 (JP 2008-251886 A) discloses a structure having a drive current supplying circuit which is connected in series with a light-emitting element between a first power supply and a second power supply, and which supplies a drive current to the light-emitting element according to a voltage on a control terminal, and a current determining circuit which determines and outputs a current according to an amount of output light of the light-emitting element. The structure further has a current-to-voltage converter circuit which converts a current determined by the current determining circuit into a voltage and outputs the converted voltage to the control terminal of the drive current supplying circuit when the control signal is in a first state, and which disconnects the output voltage terminal from the control terminal of the drive current supplying circuit when the control signal is in a second state. The structure also has a reset circuit which connects the control terminal of the drive current supplying circuit to the second power supply when the control signal is in the second state.

In some light-emitting element driving circuit systems, a plurality of light-emitting elements are placed in a matrix form, and light is sequentially emitted from each light-emitting element for a predetermined light emission period, so that light is emitted in a circulating manner When the predetermined light emission period is longer than a normally set period, if the light-emitting elements are caused to emit light in a circulating manner with the ON-OFF control of each switching element for light-emitting element connected to each light-emitting element being controlled with a preset ON time, a number of switching operations of each switching element for light-emitting element may become large, resulting in an increase in the current consumption of the light-emitting element driving circuit system.

SUMMARY

According to one aspect of the present invention, there is provided a light-emitting element driving circuit system in which a plurality of current paths, in each of which a light-emitting element and a switching element which is controlled to be switched ON and OFF for causing light to be emitted from the light-emitting element are connected in series, are placed in parallel to each other, wherein an ON time of each switching element is adjusted based on a light-emission period which is a period in which the light-emitting elements are caused to emit light in a circulating manner, such that a number of switching operations of each switching element is reduced.

According to another aspect of the present invention, there is provided a portable phone comprising the light-emitting element driving circuit system.

BRIEF DESCRIPTION OF THE DRAWINGS

A preferred embodiment of the present invention will be described in detail based on the following drawings, wherein.

DESCRIPTION OF EMBODIMENTS

Figure 1:
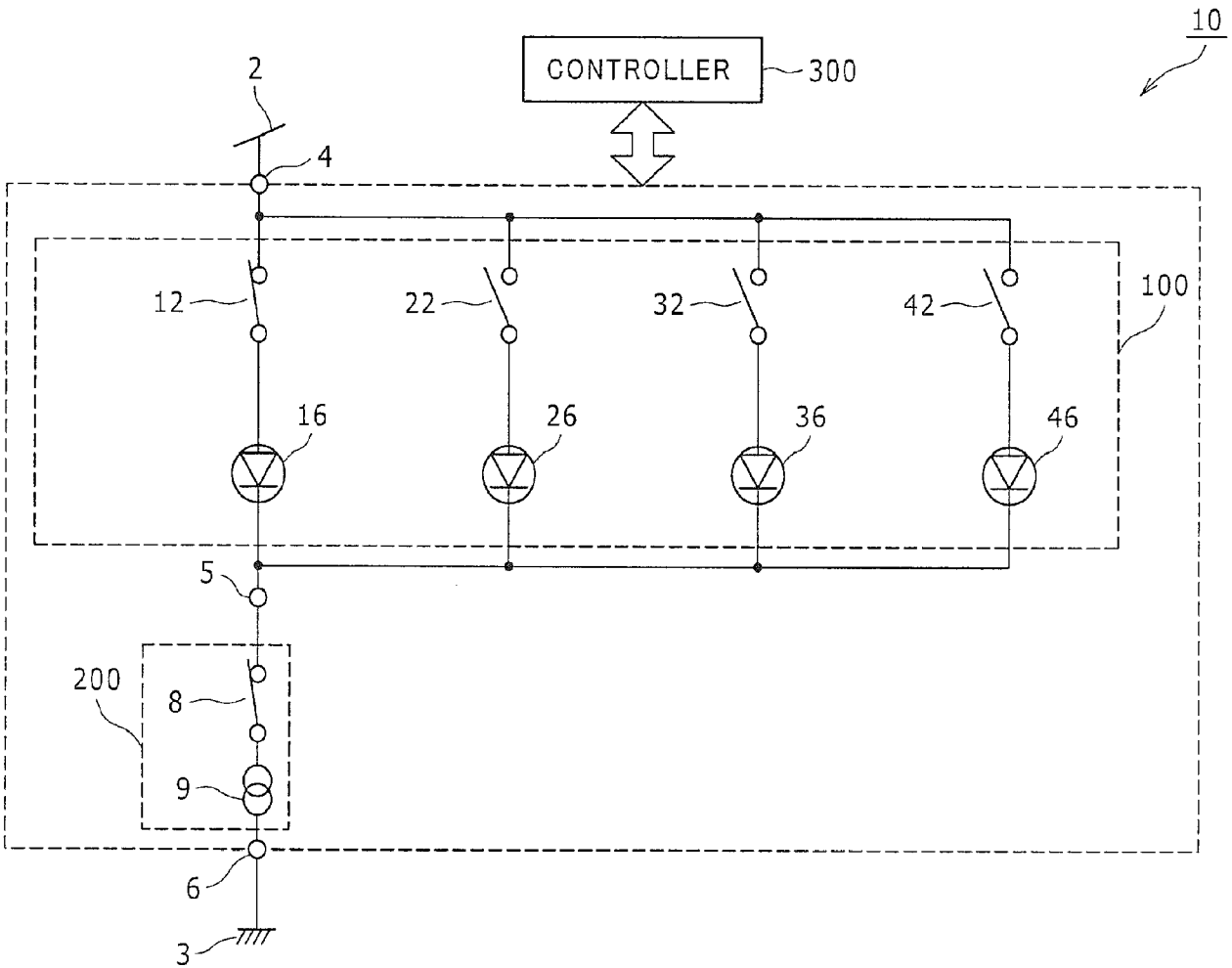
FIG. 1 is a diagram showing a light-emitting element driving circuit system according to a preferred embodiment of the present invention.

A preferred embodiment of the present invention will now be described in detail with reference to the attached drawings. In the following, similar elements in all drawings are assigned the same reference numeral, and will not be repeatedly described. In the description, reference numerals that are already mentioned will be referred to as necessary.

FIG. 1 is a diagram showing a light-emitting element driving circuit system 10. The light-emitting element driving circuit system 10 comprises a light-emission circuit unit 100, a common circuit unit 200, and a controller 300. In the following, the light-emitting element driving circuit system 10 will be described exemplifying a system which is equipped in a portable phone (In other words, cellular phone) and which drives light-emitting elements 16, 26, 36, and 46 which function as a backlight of a liquid crystal screen of the portable phone. The light-emission circuit unit 100 and the common circuit unit 200 will hereinafter also be collectively referred to as a light-emitting element driving circuit.

The light-emission circuit unit 100 is a circuit in which a plurality of current paths in each of which a light-emitting element and a switching element for the light-emitting element are connected in series are placed in parallel to each other between a power supply terminal 4 connected to an input power supply 2 and a common terminal 5. More specifically, in the light-emission circuit unit 100, a current path in which the light-emitting element 16 and a switching element for light-emitting element 12 are connected in series, a current path in which the light-emitting element 26 and a switching element for light-emitting element 22 are connected in series, a current path in which the light-emitting element 36 and a switching element for light-emitting element 32 are connected in series, and a current path in which the light-emitting element 46 and a switching element for light-emitting element 42 are connected in series, are connected and placed between the power supply terminal 4 and the common terminal 5, in parallel to each other.

The light-emitting elements 16, 26, 36, and 46 are circuit elements which emit light when a voltage is applied between an anode terminal (positive electrode) and a cathode terminal (negative electrode) in a forward direction. The light-emitting elements 16, 26, 36, and 46 have respective anode terminals connected to second terminals of the switching elements for light-emitting element 12, 22, 32, and 42, respectively, and the cathode terminals connected to the common terminal 5.

The switching elements for light-emitting element 12, 22, 32, and 42 are switching elements which are controlled to be switched ON and OFF by the controller 300, and comprise, for example, transistors. The switching elements for light-emitting elements 12, 22, 32, and 42 have first terminals connected to the power supply terminal 4 and respective second terminals connected to the anode terminals of the light-emitting elements 16, 26, 36, and 46, respectively.

The common circuit unit 200 is a circuit placed between the common terminal 5 and a ground terminal 6. A common switching element 8 is a switching element which is controlled to be switched ON and OFF by the controller 300, and comprises, for example, a transistor. The common switching element 8 has a first terminal connected to the common terminal 5 and a second terminal connected to a first terminal of a constant current source 9.

The constant current source 9 is a current source for driving the light-emitting elements 16, 26, 36, and 46 with a predefined drive current. The constant current source 9 has the first terminal connected to the second terminal of the common switching element 8 and a second terminal connected to the ground terminal 6 which is connected to the ground 3 and grounded.

The controller 300 is a control circuit having a function to control switching (ON-OFF control) of the switching elements for light-emitting elements 12, 22, 32, and 42, and the common switching element 8. With the switching control of the controller 300, the switching elements for light-emitting elements are switched in the order of the switching element for light-emitting element 12, the switching element for light-emitting element 22, the switching element for light-emitting element 32, and the switching element for light-emitting element 42, so that light emitting elements sequentially emit light in the order of the light-emitting element 16, the light-emitting element 26, the light-emitting element 36, and the light-emitting element 46. After the light-emitting element 46 emits light, the light-emitting elements again sequentially emit light in the order of the light-emitting element 16, the light-emitting element 26, the light-emitting element 36, and the light-emitting element 46. In other words, with the switching control of the controller 300 for to the switching elements for light-emitting elements 12, 22, 32, and 42, a circulating light emission of the light-emitting elements 16, 26, 36, and 46 can be realized.

A function to control light emission (lighting) of the light-emitting elements 16, 26, 36, and 46 by the controller 300 will now be described with reference to FIG. 2. The controller 300 may cause gradation lighting of the light-emitting elements 16, 26, 36, and 46 for a certain period in the overall period when the light-emitting elements 16, 26, 36, and 46 are lighted. The gradation lighting refers to a lighting state where the drive current values of the light-emitting elements 16, 26, 36, and 46 are changed in intervals of a predetermined light-emission period of L, 2L, 3L, 4L, . . . 9L, to smoothly change the brightness.

Figure 2A:
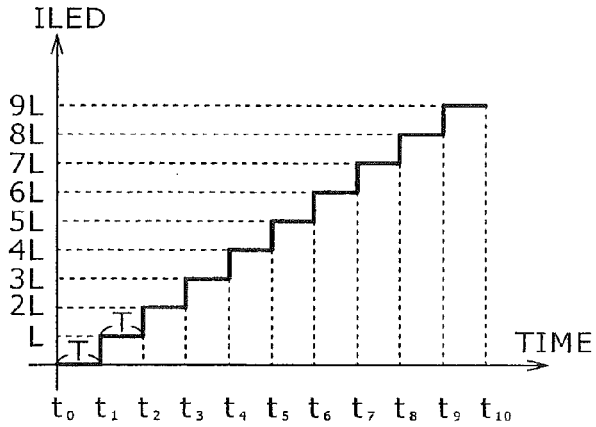
FIGS. 2A and 2B is a current characteristic diagram showing a change of a drive current value with respect to each period in a gradation lighting period in the preferred embodiment of the present invention.

FIG. 2A is a diagram showing a current characteristic of a gradation lighting period in which the drive current value (ILED) is changed from L to 9L at an interval of each light-emission period T. In FIG. 2A, in the light-emission period T from time t0 to time t1, because ILED is maintained at 0, the light-emitting elements 16, 26, 36, and 46 are not lighted.

In a light-emission period T from time t1 to time t2, the light-emitting elements 16, 26, 36, and 46 are driven with a drive current value ILED of L. Here, in the light-emitting period T from time t1 to time t2, not all of the light-emitting elements 16, 26, 36, and 46 emit light in all periods. Specifically, in the light-emission period T from time t1 to time t2, only the light-emitting element 16 is switched ON in the period of the first ¼T, only the light-emitting element 26 adjacent to the light-emitting element 16 is switched ON in the period of the next ¼T, only the light-emitting element 36 adjacent to the light-emitting element 26 is switched ON in the period of the next ¼T, and only the light-emitting element 46 adjacent to the light-emitting element 36 is switched ON in the period of the remaining ¼T. In other words, the controller 300 switches the ON control of the switching element for light-emitting element 12, the switching element for light-emitting element 22, the switching element for light-emitting element 32, and the switching element for light-emitting element 42 with a period of ¼T, so that light is sequentially emitted from the light-emitting element 16, the light-emitting element 26, the light-emitting element 36, and the light-emitting element 46. Here, the controller 300 has a function to determine the ON time of the switching elements for light-emitting elements 12, 22, 32, and 42, which will be described in detail later.

After the light-emission period T from time t1 to time t2 is completed, the period transitions to the next light-emission period T from time t2 to time t3, in which light is emitted from the light-emitting elements 16, 26, 36, and 46 with a drive current value ILED of 2L. In the light-emission period T from time t1 to time t2 described above, the light is emitted from the light emitting elements in the order of the light-emitting element 16, the light-emitting element 26, the light emitting element 36, and the light-emitting element 46, and the light-emission period T is completed after the light-emitting element 46 emits light. In the light-emission period T from time t2 to time t3, the light is emitted from the light-emitting elements again in the order of the light-emitting element 16, the light-emitting element 26, the light-emitting element 36, and the light-emitting element 46. Thus, in a combined period from time t1 through time t3, the controller 300 causes light to be emitted in a circulating manner from the light-emitting elements 16, 26, 36, and 46.

In the light-emission period T from time t2 to time t3 also, the controller 300 controls switching of the switching elements for light-emitting elements 12, 22, 32, and 42 such that the light-emitting elements 16, 26, 36, and 46 are switched and lighted with a period of ¼T. In addition, in FIG. 2A, the circulating light emission of the light-emitting elements 16, 26, 36, and 46 is continued while the ILED is changed, at an interval of the light-emission period T, to 3L, 4L, 5L, 6L, 7L, 8L, and 9L in the period from time t3 to time t10. Because of this, in the gradation lighting period, gradation lighting of the light-emitting elements 16, 26, 36, and 46 is achieved by the control of the controller 300.

Figure 2B:
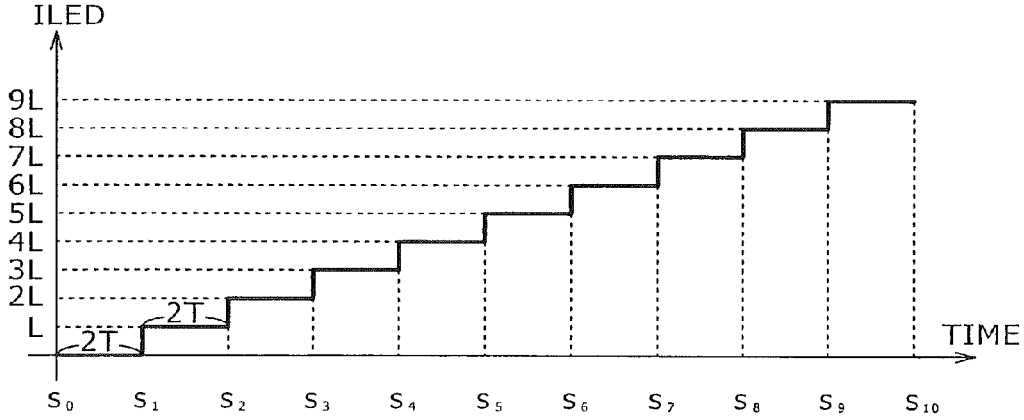

In FIG. 2A, the gradation lighting period of the light-emitting elements 16, 26, 36, and 46 is realized from time t0 to time t10 (with the interval of each light-emission period being T). FIG. 2B shows a current characteristic diagram where the gradation lighting period is twice that of FIG. 2A and is from time s0 to time s10 (with the interval of each light-emission period being 2T).

The controller 300 has a function to set a value obtained by dividing the light-emission period t of the gradation lighting period by a total number of the plurality of light-emitting elements m (t/m) as the ON time of each switching element for light-emitting elements connected to each light-emitting element. Specifically, the controller 300 has a function, in the example configuration of FIG. 2A, to execute adjustment to set a period ¼T obtained by dividing the light-emission period of the gradation lighting period (t=T) by the total number (m=4) of light-emitting elements 16, 26, 36, and 46 for circulation light-emission as the ON period of each element of the switching elements for light-emitting elements 12, 22, 32, and 42 connected to the light-emitting elements 12, 22, 32, and 42. The controller also has a function to change the switching control such that, when the light-emission period in the gradation lighting period is changed from FIG. 2A to FIG. 2B, a period ½T obtained by dividing the light-emission period after the change (t=2T) by the total number (m=4) of the light-emitting elements 16, 26, 36, and 46 is set as the ON period of the switching elements for light-emitting elements 12, 22, 32, and 42.

An operation of the light-emitting element driving circuit system 10 having the above-described structure will now be described with reference to FIGS. 1 and 2. According to the light-emitting element driving circuit system 10, ¼T obtained by dividing each light-emission period T of the gradation lighting period by the total number 4 of the light-emitting elements 16, 26, 36, and 46 is determined as the ON time of the switching elements for light-emitting elements 12, 22, 32, and 42, and the system is adjusted such that a number of switching operations in each light-emission period T is reduced. With this configuration, the circulating light-emission can be realized by the light-emitting elements 16, 26, 36, and 46 with a low current consumption.

In addition, according to the light-emitting element driving circuit system 10, when the light-emission period of the gradation lighting period is changed from T to 2T, the ON time of each switching element for light-emitting element is changed from ¼T to ½T, and when the light-emission period of the gradation lighting period is changed from T to 3T, the ON time of each switching element for light-emitting element is changed from 1/T to ¾T.

For comparison, a case where the ON time of each switching element for light-emitting element is not changed when the light-emission period in the gradation lighting period is changed from T to 2T will now be described. Because the ON time is ¼T, in each light-emission period 2T, light is emitted from the light-emitting elements in the order of the light-emitting element 16, the light-emitting element 26, the light-emitting element 36, the light-emitting element 46, the light-emitting element 16, the light-emitting element 26, the light-emitting element 36, and the light-emitting element 46. Therefore, a number of switching operations per each light-emission period 2T is twice for each switching element for the light-emitting element a when the ON time is maintained at ¼T.

On the other hand, with the light-emitting element driving circuit system 10, because the ON time of each of the switching elements for light-emitting element 12, 22, 32, and 42 is changed to ½T, in each light-emission period 2T, the light is emitted from the light-emitting elements in the order of the light-emitting element 16, the light-emitting element 26, the light-emitting element 36, and the light-emitting element 46. In other words, when the ON time is changed to ½T, the number of switching operations for each switching element for a light-emitting element is once. As described, according to the light-emitting element driving circuit system 10, even when the light-emission period is changed, the ON time can be changed to reduce the number of switching operations of each switching element for a light-emitting element, and thus an increase in the current consumption can be inhibited.

As described, according to the light-emitting element driving circuit system 10, the ON time is adjusted based on each light-emission period t (for example, T) of the gradation lighting period so that the number of switching operations of each of the switching elements for light-emitting elements 12, 22, 32, and 42 is reduced, and when each light-emission period t of the gradation lighting period is changed, for example, from T to nT (where n is an integer), the ON time for each of the switching elements for light-emitting elements 12, 22, 32, and 42 is changed to nT/m (where n and m are integers and m is 4 in the example configuration of FIG. 2), so that the number of switching operations of the switching elements for light-emitting elements 12, 22, 32, and 42 in each light-emission period is not increased, and as a result, an increase in the current consumption can be inhibited.

What is claimed is:

1. A light-emitting element driving circuit system in which a plurality of current paths, in each of which a light-emitting element and a switching element which is controlled to be switched ON and OFF for causing light to be emitted from the light-emitting element are connected in series, are placed in parallel to each other, wherein an ON time of each switching element is adjusted based on a light-emission period which is a period in which the light-emitting elements are caused to emit light in a circulating manner, such that a number of switching operations of each switching element is reduced.

2. The light-emitting element driving circuit according to claim 1, wherein the ON time of each switching element is adjusted such that a time period obtained by dividing the light-emission period by a total number of the plurality of the light-emitting elements is set as the ON time of each switching element.

3. The light-emitting element driving circuit system according to claim 2, wherein when the light-emission period is changed, the control to switch ON and OFF is changed such that a time period obtained by dividing the light-emission period after the change by the total number of the plurality of the light-emitting elements is set as the ON time of each switching element.

4. A portable phone comprising:

a light-emitting element driving circuit system in which a plurality of current paths, in each of which a light-emitting element and a switching element which is controlled to be switched ON and OFF for causing light to be emitted from the light-emitting element are connected in series, are placed in parallel to each other, wherein an ON time of each switching element is adjusted based on a light-emission period which is a period in which the light-emitting elements are caused to emit light in a circulating manner, such that a number of switching operations of each switching element is reduced.

* * * * *